US006130512A

United States Patent [19]

Manos et al.

[11] Patent Number: 6,130,512

[45] Date of Patent: Oct. 10, 2000

[54] RF CAPACITIVELY-COUPLED ELECTRODELESS LIGHT SOURCE

[75] Inventors: Dennis M. Manos, Williamsburg; Jessie Diggs, Norfolk; Joseph D. Ametepe, Roanoke, all of Va.; Jock A. Fugitt, Livingston, Tex.

[73] Assignees: College of William & Mary, Williamsburg; SURA, Newport News, both of Va.

[21] Appl. No.: 09/382,936

[22] Filed: Aug. 25, 1999

[51] Int. Cl.[7] ..... H05B 41/16

[52] U.S. Cl. ..... 315/248; 315/348; 315/344

[58] Field of Search ..... 315/248, 39, 39.61, 315/39.53, 344, 267, 634, 234, 348

[56] References Cited

U.S. PATENT DOCUMENTS

| | | | |
|---|---|---|---|
| 3,679,997 | 7/1972 | Friedl et al. . | |
| 4,381,564 | 4/1983 | Newman . | |
| 4,427,921 | 1/1984 | Proud et al. . | |
| 4,748,634 | 5/1988 | Hesterman . | |
| 5,140,227 | 8/1992 | Dakin et al. | 315/248 |
| 5,248,918 | 9/1993 | Dakin et al. | 315/248 |
| 5,343,114 | 8/1994 | Beneking et al. . | |
| 5,637,963 | 6/1997 | Inoue et al. | 315/248 |
| 5,689,523 | 11/1997 | Seguin . | |
| 5,834,904 | 11/1998 | Waymouth | 315/248 |

OTHER PUBLICATIONS

B.M. Alexandrovich, R.B. Piejak, V.A. Godyak, "Frequency Dependence of RF–Driven Subminiature Fluorescent Lamp," Journal of the Illuminating Engineering Society, Winter 1996, vol. 25, No. 1, pp. 93–99.

Joseph D. Ametepe, Jessie Diggs, Dennis M. Manos, and Michael J. Kelley, "Characterization and Modeling of a Microwave Driven Xenon Excimer Lamp," Journal of Applied Physics, Jun. 1, 1999, vol. 85, No. 11, pp. 7505–7510.

*Primary Examiner*—Don Wong
*Assistant Examiner*—Trinh Vo Dinh
*Attorney, Agent, or Firm*—Joy L. Bryant

[57] ABSTRACT

An rf capacitively-coupled electrodeless light source is provided. The light source comprises a hollow, elongated chamber and at least one center conductor disposed within the hollow, elongated chamber. A portion of each center conductor extends beyond the hollow, elongated chamber. At least one gas capable of forming an electronically excited molecular state is contained within each center conductor. An electrical coupler is positioned concentric to the hollow, elongated chamber and the electrical coupler surrounds the portion of each center conductor that extends beyond the hollow, elongated chamber. A rf-power supply is positioned in an operable relationship to the electrical coupler and an impedance matching network is positioned in an operable relationship to the rf power supply and the electrical coupler.

14 Claims, 7 Drawing Sheets

RF CAPACITIVELY-COUPLED ELECTRODELESS LIGHT SOURCE

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of SURA Contract Nos. 94D8358901 and DE-AC05-84ER40150 awarded by the Department of Energy.

FIELD OF THE INVENTION

The present invention relates to electrodeless ultra-violet (uv) light sources. In particular, radio frequency (rf) capacitively-coupled electrodeless light sources.

BACKGROUND OF THE INVENTION

Excimers are diatomic molecules or complexes of molecules that have stable excited states with an unbound or weakly bound ground state. In principle, they can be formed by all rare gases and rare-gas halogen mixtures and in most cases, the reaction kinetics leading to the excimer is selective. Because these complexes are unstable, they disintegrate within a few nanoseconds converting their excitation energy to spontaneous optical emission. Re-absorption of this light cannot occur because these complexes have no stable ground state. In turn, it is possible to construct excimer lamps emitting light with a high intensity within narrow spectral regions in the deep uv. Many materials absorb radiation at less than approximately 250 nm, making uv or vuv sources important. In turn, these sources can selectively drive radical-mediated processes such as: uv curing, metal depositions, protective and functional coating, pollution control, photo-deposition of amorphous semiconductors, and photo-deposition of dielectric layers.

Many different electrical discharge techniques have been used to drive excimer emission. Such techniques include dielectric barrier discharge, uv preionization, microwave discharge, pulsed longitudinal discharges, continuous longitudinal discharge, nuclear excitation, and hollow cathode discharge. Alexandrovich et al. (B. M. Alexandrovich, R. B. Piejak, V. A. Godyak, "Frequency Dependence of RF-Driven Subminiature Fluorescent Lamp," *Journal of the Illuminating Engineering Society*, Vol. 25, No. 1, p. 93–99, (1996)) describe capacitively coupled rf discharges for electrodeless subminiature fluorescent lamps with mercury/argon gas mixtures. However, they fail to report the use of capacitively coupled rf discharge to produce excimer emission.

Previous rf designs were configured to avoid electrodes internal to the plasma, the dominant capacitively or inductively coupled designs employ external tunable inductors and/or capacitors to create an impedance match between a tuned cavity and the power supply. Such designs require precise tuning.

Lamps that have strong emissions in the 180 nm–200 nm region are desirable because of the responsiveness of organic materials in this wavelength range. Previous argon/fluorine lamp mixtures, although producing emissions at 193 nm, were limited in utility because the fluorine attacked the quartz from which the bulbs are usually made. Lamps based on the 190 nm krypton/iodine excimer face the problem of iodine condensation. In turn, it is desirable to have a lamp containing a gas capable of forming an electronically excited molecular state that can be contained with a center conductor without producing adverse reactions or side-effects.

It is an object of the present invention to provide an rf capacitively-coupled electrodeless light source.

A further object of the present invention is to provide an rf capacitively-coupled electrodeless light source that incorporates a tuner as both part of the cabling to the power supply in addition to serving as an integral part of the lamp cavity.

Another object of the present invention is to provide an rf capacitively-coupled electrodeless light source that eliminates the need for precise tuning.

SUMMARY OF THE INVENTION

By the present invention, an rf capacitively-coupled electrodeless light source is provided that eliminates the precise tuning requirement, resulting in a simple, efficient, and compact system. The invention may be used for various uv applications such as material processing, deposition, etching, and other plasma processing operations.

The rf capacitively-coupled electrodeless light source comprises a hollow, elongated chamber. At least one center conductor is disposed within the chamber such that a portion of each center conductor extends beyond the chamber. At least one gas capable of forming an electronically excited molecular state is contained within each center conductor. An electrical coupler is positioned concentric to the chamber such that the electrical coupler surrounds the portion of each center conductor that extends beyond the chamber. An rf-power supply is positioned in an operable relationship to the coupler and an impedance matching network is positioned in an operable relationship to the rf power supply and the electrical coupler.

The device of the present invention may be used to produce an excimer emission by providing the device and introducing at least one gas capable of forming an electronically excited molecular state into each center conductor. Each gas is pressurized in a range from about 0.2 torr to about 1500 torr. Rf power ranging from about 200 W to about 3000 W is input into the impedance matching network. An excimer emission ranging from about 160 nm to about 200 nm is produced.

Additional objects and advantages of the invention will be set forth in part in the description which follows, and in part will be obvious from the description, or may be learned by practice of the invention. The objects and advantages of the invention will be obtained by means of instrumentalities in combinations particularly pointed out in the appended claims.

BRIEF DESCRIPTION OF THE DRAWINGS

The accompanying drawings illustrate a complete embodiment of the invention according to the best modes so far devised for the practical application of the principles thereof, and in which.

DETAILED DESCRIPTION OF THE PREFERRED EMBODIMENTS

Figure 1:
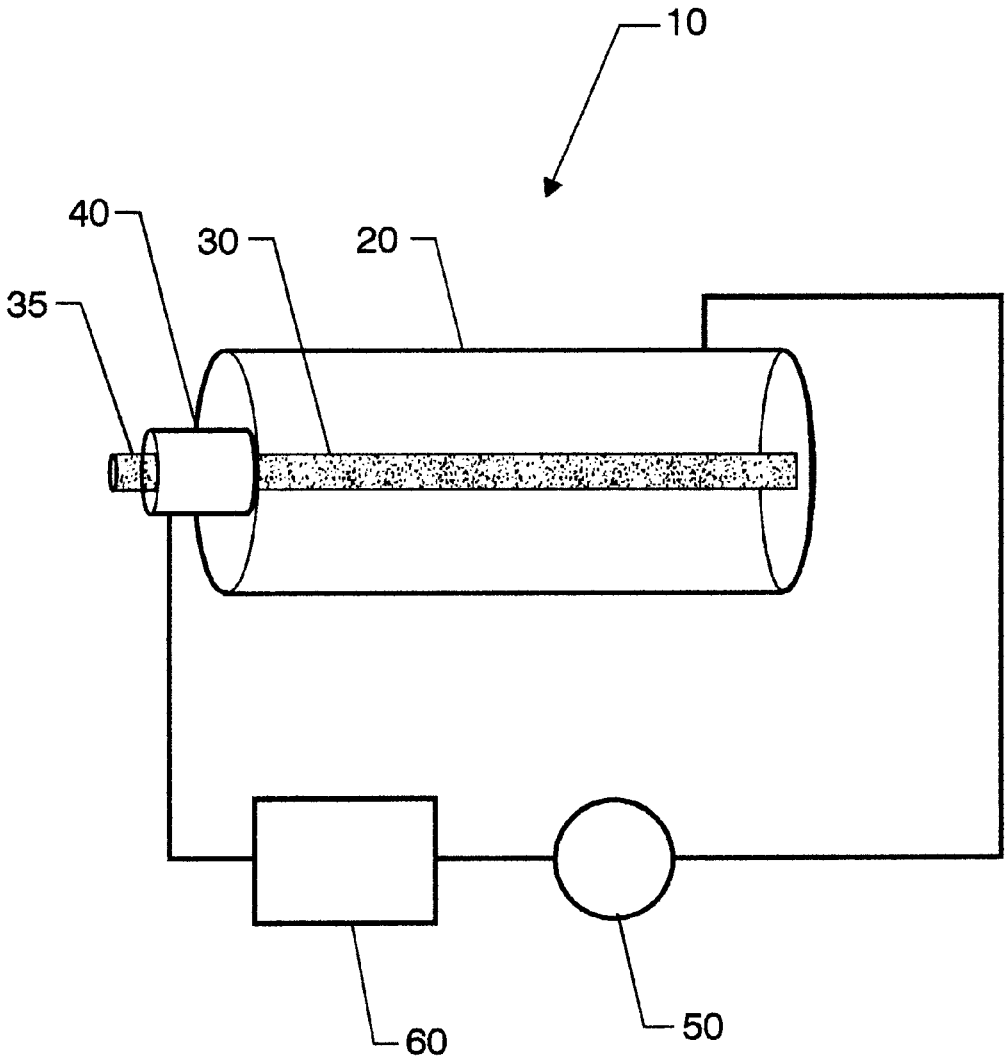
FIG. 1 is a side view of the rf capacitively-coupled electrodeless light source.
Figure 2:
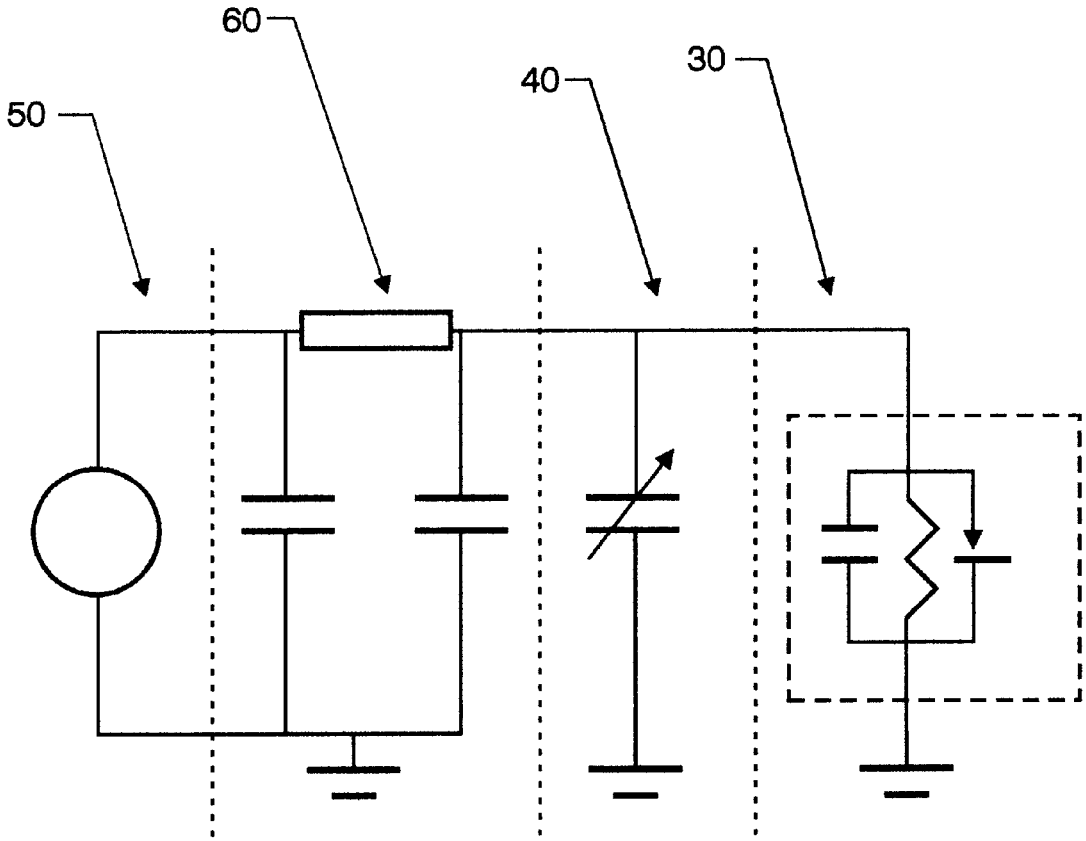
FIG. 2 is an electrical circuit diagram for the rf capacitively-coupled electrodeless light source.

Referring now to the drawings where similar elements are numbered the same, FIG. 1 depicts the rf capacitively-coupled electrodeless light source 10 of the present invention and FIG. 2 is the equivalent electrical circuit diagram of the present invention. The light source 10 comprises a hollow, elongated chamber 20. The chamber may have any configuration known to those skilled in the art such as a cylindrical or elliptical shape. Preferably, the chamber is grounded. At least one center conductor 30 is disposed within the hollow, elongated chamber 20. A portion 35 of each center conductor 30 extends beyond the hollow, elongated chamber 20. The center conductor 30 serves as a bulb. Although only one center conductor 30 is shown, more than one center conductor may be disposed within the chamber to form a bundle-type configuration. The center conductor 30 may be either an open-ended, cylindrical tube or a sealed cylindrical tube depending on the final application. Typically, the center conductor has a varied gas volume typically on the order of cubic centimeters. For example, the gas volume may range from about 25 $cm^3$ to about 66 $cm^3$.

To complete the bulb-type configuration, at least one gas (not shown) capable of forming an electronically excited molecular state, is contained within each center conductor. Any gas or combinations of gases capable of forming an electronically excited molecular state may be used. Examples of these gases include but are not limited to: xenon, argon, krypton, iodine, and fluorine either pure in form or in combination with one another. Preferably, the gas is a xenon/argon gas mixture. Preparation of the gas mixture entails introducing small quantities of xenon into the center conductor and back filling the center conductor with argon to the desired pressure. Typical pressures range from about 0.2 torr to about 1500 torr. Care must be taken to purge the center conductor of all residual gases, especially oxygen. Traces of oxygen prevent the desired excimer formation and lead instead to xenon-oxide, which forms a visible, green discharge.

In some instances, it is desirable to control the temperature of each center conductor and enhance ignition of the gas(es). This is achieved by positioning an ignition system in relationship to each center conductor such that the ignition system can deliver a two-phase cryogenic stream to each center conductor. Preferably, the ignition system comprises at least one spray nozzle, preferably of copper. The ignition system is installed by drilling a hole in the hollow, elongated chamber and inserting the spray nozzle into the hole. The spray nozzle permits the delivery of a two-phase cryogenic stream along the length of the center conductor. In one embodiment, the two-phase cryogenic stream is the boil-off from liquid nitrogen. It was found that cooling the center conductor causes condensation of the gas mixture. This lowers the pressure and leads to ignition of the gas in the center conductor by a modest electric field.

An electrical coupler 40 is positioned concentric to the hollow, elongated chamber 20. A typical electrical coupler 40 is a cylindrical conductor having a length of 7.5 to 12.5 cm and a diameter of 5 to 7.5 cm. The electrical coupler 40 surrounds the portion of each center conductor 35 that extends beyond the hollow, elongated chamber 20. The electrical coupler 40 couples power from the rf-power supply 50 to the center conductor 30. In addition, the electrical coupler 40 also provides an adjustable capacitance between the center conductor 30 and the hollow, elongated chamber 20. The adjustments to the capacitance may be made either manually or automatically depending on the application.

The rf-power supply 50 is positioned in an operable relationship to the electrical coupler 40. The operable relationship is defined by the rf supply output being connected to the electrical coupler. The rf power supply return is connected to the elongated chamber. A typical rf-power supply will deliver up to 1 kW of 13.56 MHz into a 50 ohm load.

An impedance matching network 60 is positioned in an operable relationship to the rf-power supply 50 and the electrical coupler 40. The impedance matching network 60 transforms the cavity 20 and each center conductor's 30 electric load impedance into a real resistance of about 50 ohms. Preferably, the impedance matching network 60 is a pi network comprising two variable capacitors and a fixed inductor. When power is applied, the impedance matching network 60 attempts to transform the capacitive reactance into a resistive impedance. The electrical coupler 40 cannot transform a pure reactance into a purely resistive (50 ohm) resistance. By moving the electrical coupler 40 in or out of the hollow, elongated chamber 20, the reflected power is reduced and the electrical coupling is increased, making ignition of the gas possible. In turn, the electrical matching of the light source load to the rf supply is enhanced.

In use, the rf capacitively-coupled electrodeless light source is provided. At least one gas capable of forming an electronically excited molecular state is introduced into each center conductor. Preferably, the gas is a xenon/argon gas mixture. The gas is pressurized in a range from about 0.2 torr to about 1500 torr, depending on the application. Rf power ranging from about 200 W to about 3000 W is input into the impedance matching network. An excimer emission ranging from about 160 nm to about 200 nm is then produced. In a preferred embodiment, pressure is applied at a range from about 500 torr to about 1000 torr at an input rf power ranging from about 300 W to about 1000 W. Lastly, in a preferred embodiment of the invention, a two-phase cryogenic stream is delivered to each center conductor.

EXAMPLES

Example 1

An rf capacitively-coupled electrodeless light source was assembled in the following manner. The light source consisted of an rf generator, impedance matching network, an electrical coupler, and a center conductor in a grounded cylindrical cavity. The rf generator (model ACG-10 commercially available from ENI Power System, Inc.) delivers up to 1 kW of 13.56 MHz into a 50 ohm load. The impedance matching network transforms the light source and cavity electrical load impedance ($Z=R+jX_c$) into a constant 50 ohm of pure resistance. The electrical coupler was a cylindrical conductor of length 7.5–12.5 cm and diameter of 5–7.5 cm. The electrical coupler was placed concentric to the cavity and provided an adjustable capacitance between the center conductor and ground. Since the electrical coupler was outside the center conductor, problems associated with having an electrode in contact with the plasma were eliminated. In addition, the light output of the light source was not obstructed. The center conductor was an open-ended, cylindrical tube, having an 8 mm outer diameter (6 mm inner diameter) by 50 cm long with a radiating surface area of approximately 125 $cm^2$ and a gas volume of 14.1 $cm^3$. The light source was housed in an electromagnetic shield to eliminate rf leakage.

EXAMPLE 2

Figure 3:
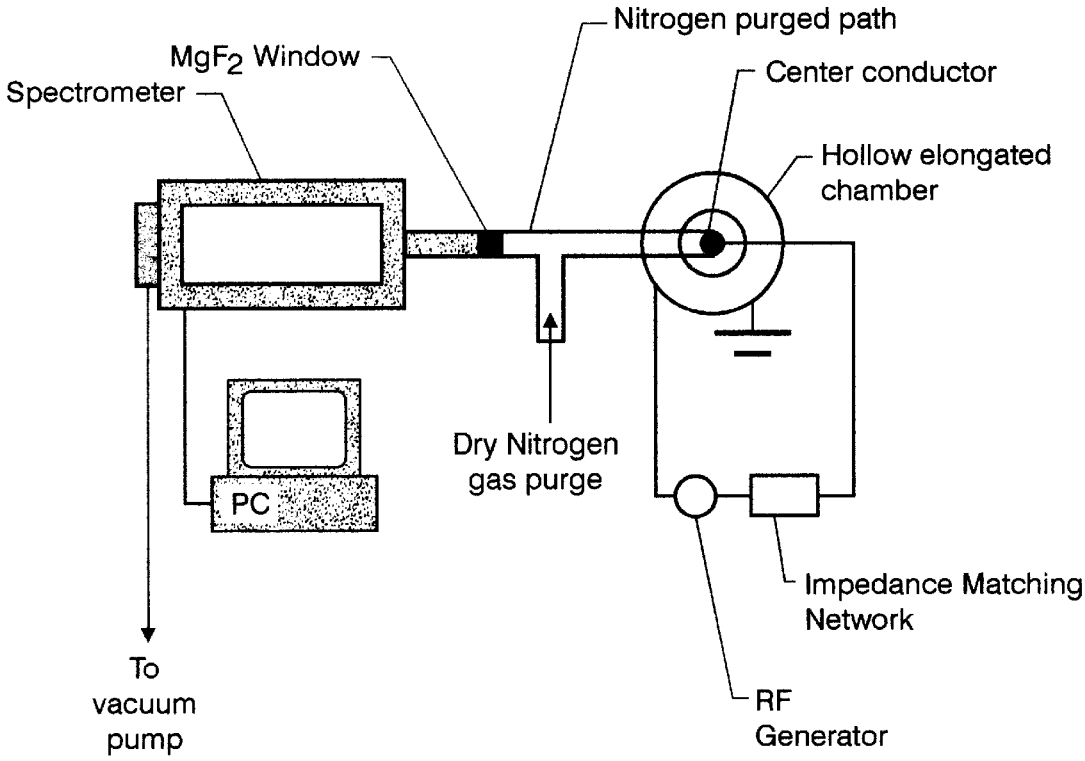
FIG. 3 depicts the experimental arrangement used for testing the light source.

The light source from Example 1 was characterized using the experimental arrangement shown in FIG. 3. A spectrometer based on a 0.3 meter McPherson Model 218 vacuum scanning monochromater was constructed. Light from the light source reached the spectrometer through a 4 mm inner diameter tube which had been purged with dry nitrogen to avoid light absorption by atmospheric oxygen below 200 nm. The tube was 10 cm long and created an effective 2.3 degree angular aperture for the detector. One end of the tube contacted the center conductor perpendicular to the longitudinal axis of the center conductor. The other end of the tube contacted an $MgF_2$ window in front of the entrance slit of either the spectrometer or the power meter.

Due to the large cross-section for electronic energy transfer in Xe—Ar mixtures, care must be taken to ensure the purity of the gases used. The center conductor was cleaned with isopropyl alcohol and heated to approximately 450° C. under vacuum before introducing research grade Ar and Xe gas. To ensure mixing of the gases, small quantities of Xe were admitted first and allowed to diffuse throughout the center conductor. The center conductor was then back-filled with Ar to the desired pressure. Reproducibility of the data was checked after several days with no detectable changes, confirming complete mixing. A general purity check of the gas handling system was also performed by monitoring the vacuum uv emission spectra at approximately 200 torr. No atomic emissions from impurity gases were observed. The experiments were restricted to the range of 160 nm to 320 nm. Data was obtained over the pressure range of 10 torr to 1500 torr, which is a typical pressure range for excimer formation. During operation, the temperature of the center conductor was controlled by flowing either high-speed air or cold nitrogen (boil-off from liquid nitrogen) along the length of the center conductor. The temperature of the cold nitrogen was approximately 100 degrees K when it entered the lamp housing.

To efficiently examine the full parametric variation of Xe/Ar mixtures, a Latin-Square design of experiments was used to generate a matrix of 25 experimental runs spanning 5 choices of values for three variables: power, pressure, and gas composition. The choice of parameter ranges was based on preliminary experimental runs. Discharge characteristics were found to be very similar over the pressure ranges of 0.2 torr to 10 torr and over the range of 25 torr to 100 torr, hence the choice of 10 and 100 torr to represent very low and low pressure operation. The upper limit, 1500 torr, was set by the mechanical strength of the thin-wall (1 mm) of the center conductor used. A remote infrared temperature sensor was used to estimate the temperature of the center conductor. It was estimated that the temperature of the center conductor surface reached approximately 1000° C. at input powers of approximately 900 W. The upper limit on the input power was set to prevent the center conductor from over-heating and rupturing. When better means for cooling the center conductor are employed, the light source is operational at several kW. A 5 minute pre-conditioning period was found to be necessary for the discharge to completely stabilize for each set of parameters. Power and/or spectral data were collected from 11 to 15 minutes. Each set of parameters was repeated two to three times to check reproducibility. Occasionally, data sets were further repeated after several days to ascertain reproducibility.

EXAMPLE 3

Figure 4:
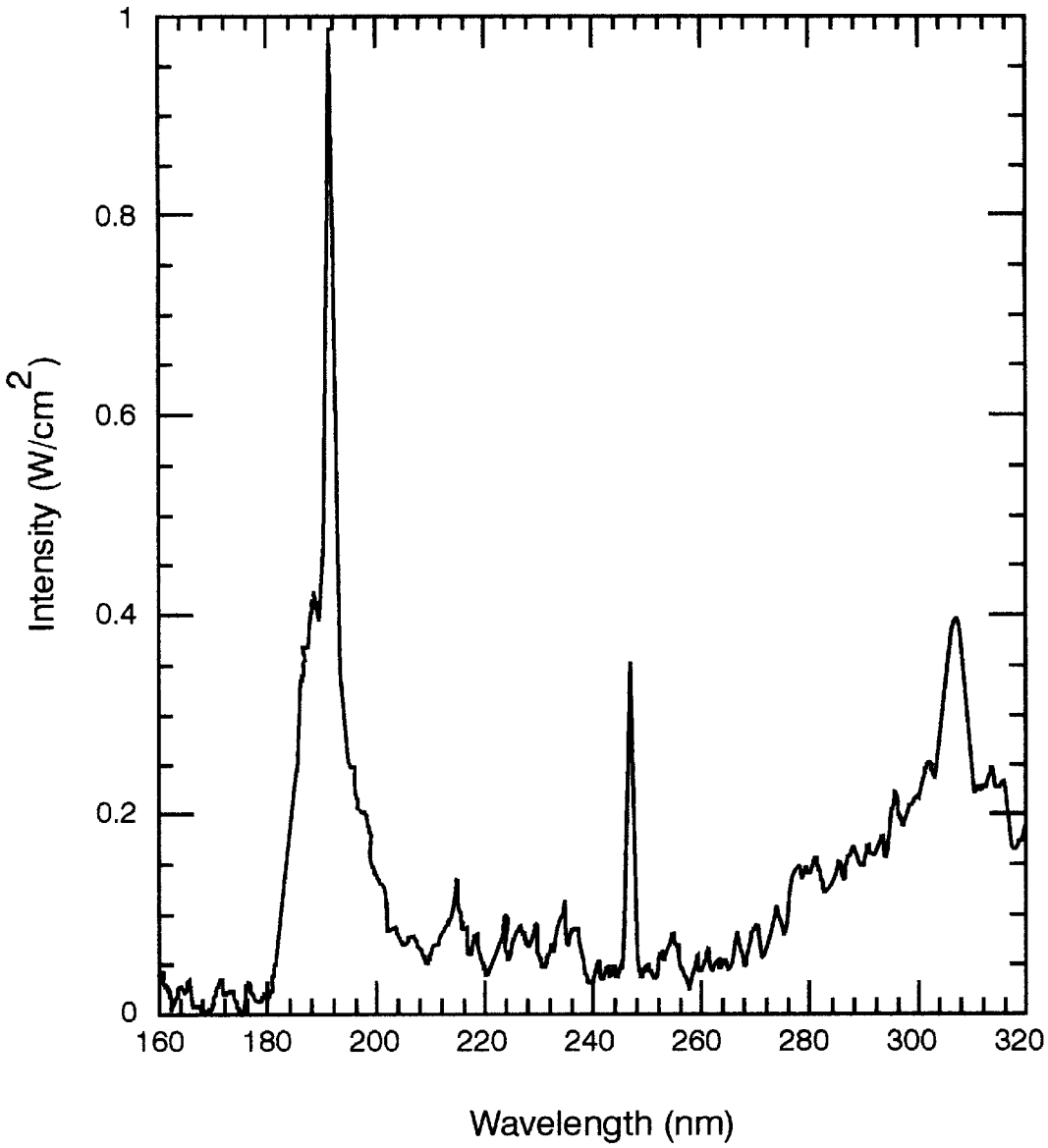
FIG. 4 shows the emission spectrum of Xe/Ar mixture in the 13.56 MHz light source at approximately 500 torr with 1% Xe concentration.

A Xenon/Argon gas mixture was used in the apparatus of Example 2. FIG. 4 shows the emission of Xe/Ar mixture in the 13.56 MHz light source at approximately 500 torr with 1% Xe concentration. Two kinds of emission dominate the spectra, an emission at $\lambda$=~142 nm (not shown) and a second emission between the region of 180 nm and 200 mn containing a sharp line at 193 nm. The emission peaking at 142 nm results from the energy transfer processes.

Figure 5:
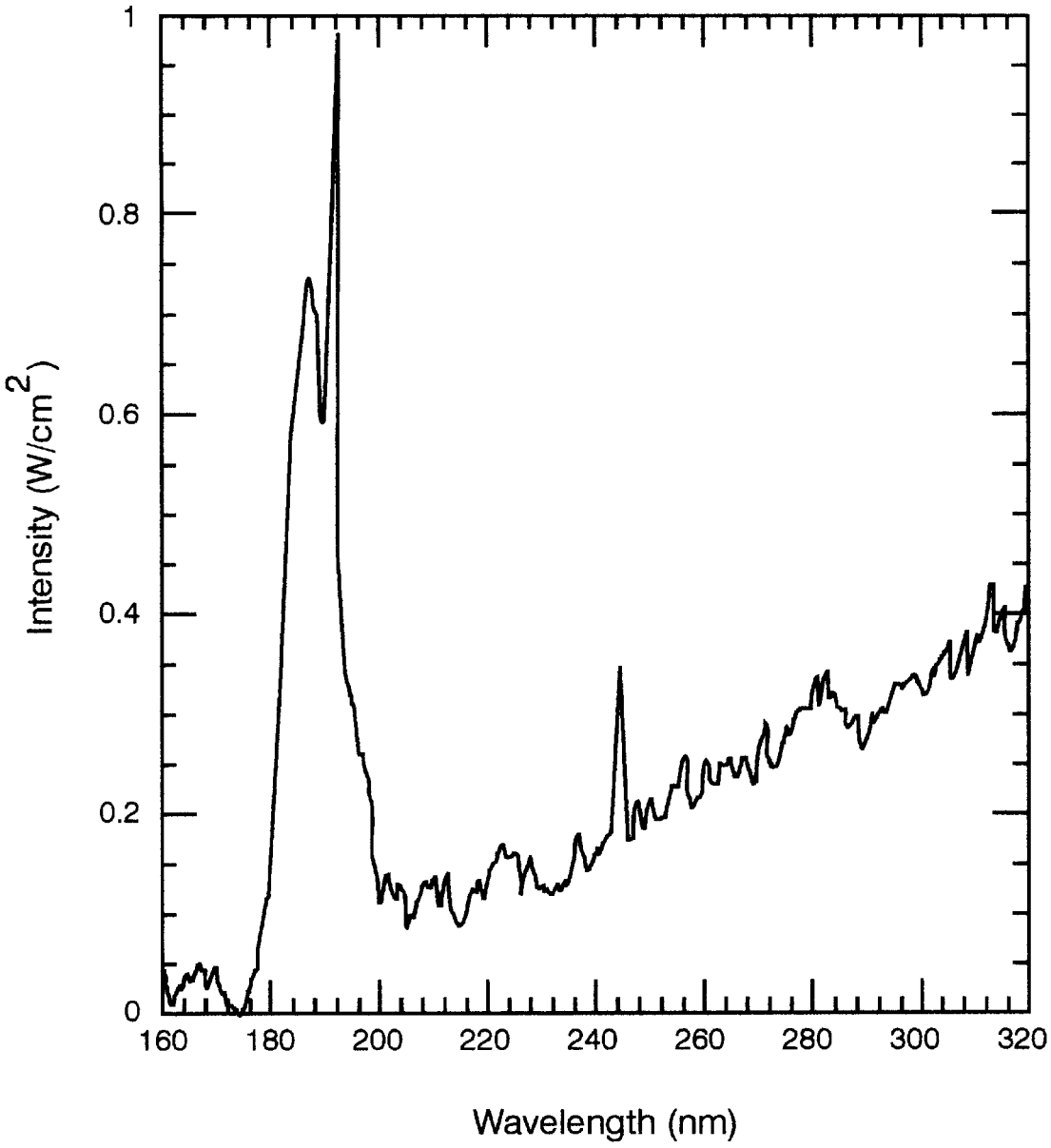
FIG. 5 shows the emission spectrum of a Xe/Ar mixture when pressure has been increased to 1000 torr with 5% Xe.

A pressure increase to approximately 1000 torr with 5% Xe (FIG. 5) causes a strong emission at 193 nm. This behavior with regard to changes of increasing pressure and power is similar to that of the molecular emission of Xe. For Xe concentrations greater than 1%, the intensity of the 180 nm to 200 nm emission approaches that of pure Xe. The observation of an emission peak at 193 nm was unexpected and has never been seen before.

Figure 6:
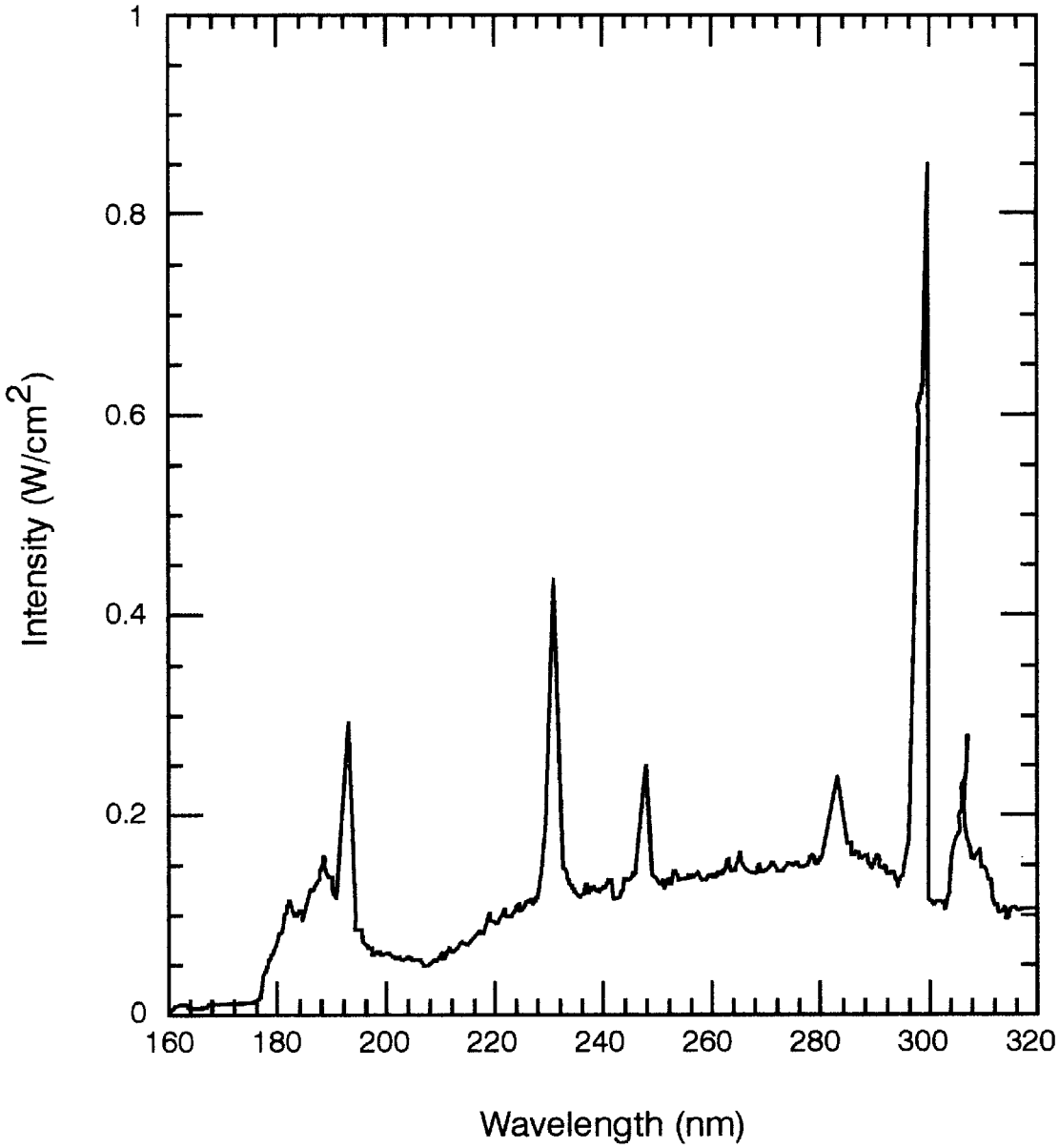
FIG. 6 shows the emission spectrum of a Xe/Ar mixture at 0.1% Xe concentration at approximately 10 torr with 300 W input rf power.
Figure 7:
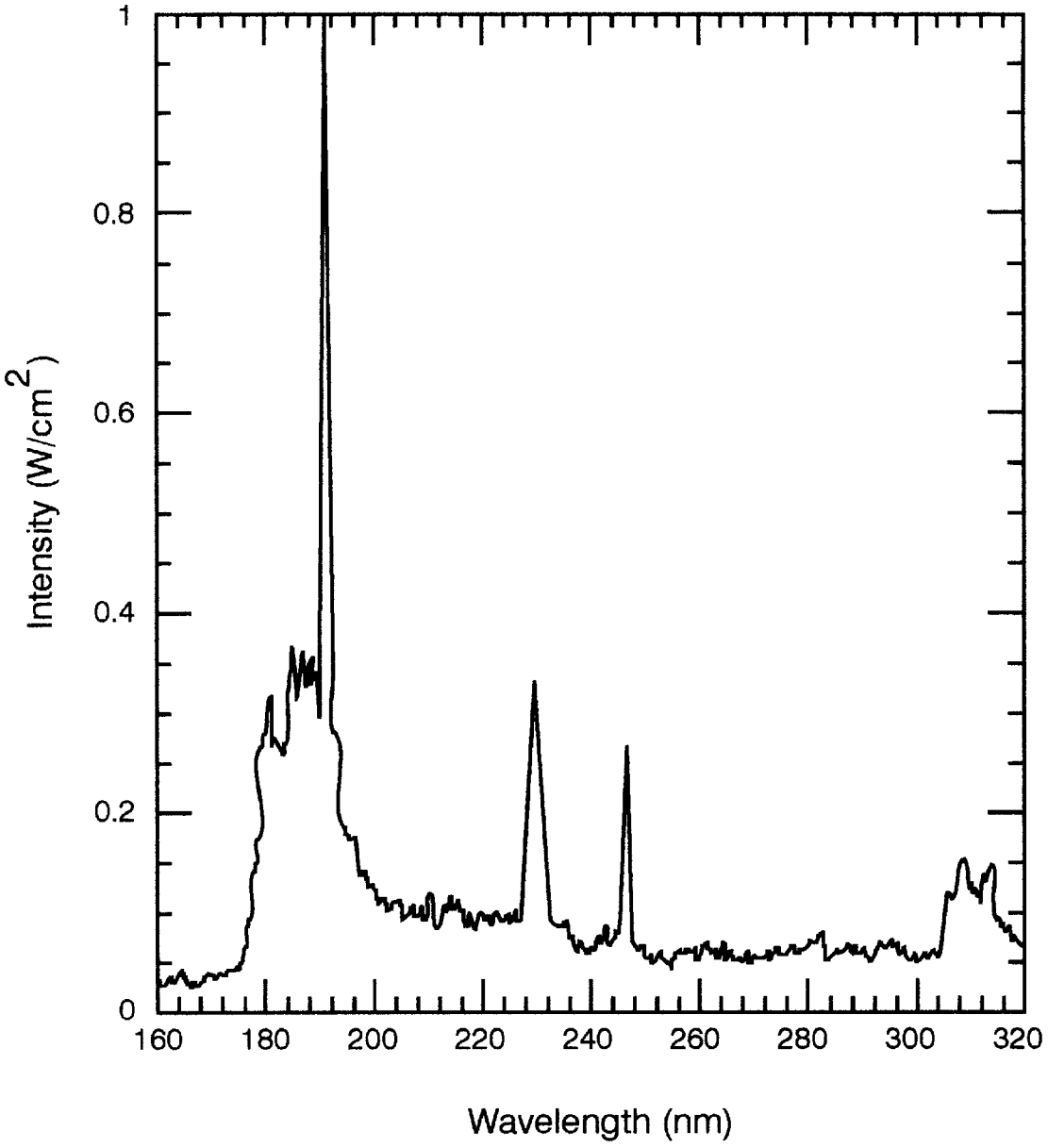
FIG. 7 shows the emission spectrum of a Xe/Ar mixture as pressure was increased to 100 torr with 1% Xe.

FIG. 6 shows the emission spectrum of a Xe/Ar mixture at 0.1% Xe concentration at approximately 10 torr with 300 W input rf power. Molecular bands were observed at 230, 247, 270 and 295 nm. As pressure was increased to 100 torr (FIG. 7) with 1% Xe, the molecular bands at 270 nm and 295 nm diminish in intensity with a relatively weak emission between 180 and 200 nm having a narrow line superimposed on it at 193 nm. In the pressure range of 10 to approximately 100 torr, increasing input power gives rise to other atomic and molecular emissions but does not increase emission from 180 nm to 200 nm. At approximately 100 torr with greater than or equal 350 W input power, the atomic and molecular emission appearing at lower pressures begin to disappear. In all cases, at pressures greater than 200 torr, increasing the Xe concentration did not change the position of the 193 emission. The only known Ar atomic line listed in standard atomic table is a doubly ionized Ar line, which is usually a weak emitter in Ar arc system.

The production of the 193 nm line and emission in the 180 nm to 200 nm range using Xe/Ar gas mixture in a 13.56 MHz rf excimer lamp is unique. A combination of high operating pressure and rf input powers of greater than or equal 300 W favors efficient emission in 180 nm to 200 nm region. At pressures greater than 500 torr, increasing input power enhances the 180 nm to 200 nm emission. The greatest emission in this ban was obtained at approximately 1000 torr with input powers of greater than 350 W.

The total optical power output for the Xe/Ar gas mixture experiments varied from 50 W to approximately 200 W at input powers of between 200 W to 1000 W. More than 80% of the emission appears at <200 nm and the best experimental efficiency (light output in the range of 180 nm to 200 nm divided by the electrical input power) is 20%.

The above description and drawings are only illustrative of preferred embodiments which achieve the objects, features and advantages of the present invention, and it is not intended that the present invention be limited thereto. Any modification of the present invention which comes within the spirit and scope of the following claims is considered part of the present invention.

What is claimed is:

1. An rf capacitively-coupled electrodeless light source comprising:

a hollow, elongated chamber;

at least one center conductor disposed within the hollow, elongated chamber, wherein a portion of each center conductor extends beyond the hollow, elongated chamber;

at least one gas capable of forming an electronically excited molecular state, wherein each gas is contained within each center conductor;

an electrical coupler positioned concentric to the hollow, elongated chamber, wherein the electrical coupler surrounds the portion of each center conductor that extends beyond the hollow, elongated chamber and wherein the electrical coupler comprises a cylindrical conductor that provides an adjustable capacitance between the center conductor and the hollow, elongated chamber;

an rf-power supply positioned in an operable relationship to the electrical coupler; and an impedance matching network positioned in an operable relationship to the rf power supply and the electrical coupler.

2. An rf capacitively-coupled electrodeless light source according to claim 1, further comprising an electromagnetic shield serving as a housing surrounding the rf capacitively-coupled electrodeless light source.

3. An rf capacitively-coupled electrodeless light source according to claim 1, wherein the center conductor is a sealed cylindrical tube.

4. An rf capacitively-coupled electrodeless light source according to claim 3, wherein the gas is a Xenon/Argon gas mixture disposed within the sealed cylindrical tube.

5. An rf capacitively-coupled electrodeless light source comprising:

a hollow, elongated chamber;

at least one center conductor disposed within the hollow, elongated chamber, wherein a portion of each center conductor extends beyond the hollow, elongated chamber and wherein each center conductor is an open-ended, cylindrical tube;

at least one gas capable of forming an electronically excited molecular state, wherein each gas is contained within each center conductor;

an electrical coupler positioned concentric to the hollow, elongated chamber, wherein the electrical coupler surrounds the portion of each center conductor that extends beyond the hollow, elongated chamber;

an rf-power supply positioned in an operable relationship to the electrical coupler; and an impedance matching network positioned in an operable relationship to the rf power supply and the electrical coupler.

6. An rf capacitively-coupled electrodeless light source according to claim 5, wherein the gas is a Xenon/Argon gas mixture disposed within the openended, cylindrical tube.

7. An rf capacitively-coupled electrodeless light source comprising:

a hollow, elongated chamber;

at least one center conductor disposed within the hollow, elongated chamber, wherein a portion of each center conductor extends beyond the hollow, elongated chamber;

at least one gas capable of forming an electronically excited molecular state, wherein each gas is contained within each center conductor;

an electrical coupler positioned concentric to the hollow, elongated chamber, wherein the electrical coupler surrounds the portion of each center conductor that extends beyond the hollow, elongated chamber;

an rf-power supply positioned in an operable relationship to the electrical coupler; and an impedance matching network positioned in an operable relationship to the rf power supply and the electrical coupler wherein the impedance matching network is a pi network comprising two variable capacitors and a fixed inductor.

8. An rf capacitively-coupled electrodeless light source according to claim 7, wherein the impedance matching network transforms electrical load impedance from each center conductor into a constant resistance of about 50 ohms.

9. A method for producing an excimer emission in an rf capacitively-coupled electrodeless light source, the method comprising the steps of:

a) providing an rf capacitively-coupled electrodeless light source comprising:

a hollow, elongated chamber;

at least one center conductor disposed within the hollow, elongated chamber, wherein a portion of each center conductor extends beyond the hollow, elongated chamber;

an electrical coupler positioned concentric to the hollow, elongated chamber, wherein the electrical coupler surrounds the portion of each center conductor that extends beyond the hollow, elongated chamber;

an rf-power supply positioned in an operable relationship to the coupler; and an impedance matching network positioned in an operable relationship to the rf power supply and the coupler;

b) introducing at least one gas capable of forming an electronically excited molecular state into each center conductor;

c) pressurizing each gas in a range from about 0.2 torr to about 1500 torr;

d) delivering a two-phase cryogenic stream to each center conductor;

e) inputting rf power into the impedance matching network wherein the rf power ranges from about 200 W to about 3000 W; and f) producing an excimer emission ranging from about 160 nm to about 200 nm.

10. An rf capacitively-coupled electrodeless light source comprising:

a hollow, elongated chamber;

at least one center conductor disposed within the hollow, elongated chamber, wherein a portion of each center conductor extends beyond the hollow, elongated chamber;

at least one gas capable of forming an electronically excited molecular state, wherein each gas is contained within each center conductor;

an ignition system positioned in an operable relationship to the center conductor wherein the ignition system delivers a two-phase cryogenic stream to each center conductor;

an electrical coupler positioned concentric to the hollow, elongated chamber, wherein the electrical coupler surrounds the portion of each center conductor that extends beyond the hollow, elongated chamber;

an rf-power supply positioned in an operable relationship to the electrical coupler; and an impedance matching network positioned in an operable relationship to the rf power supply and the electrical coupler.

11. An rf capacitively-coupled electrodeless light source according to claim 10, wherein the ignition system comprises at least one spray nozzle.

12. A method for producing an excimer emission in an rf capacitively-coupled electrodeless light source, the method comprising the steps of:

a) providing an rf capacitively-coupled electrodeless light source comprising:

a hollow, elongated chamber;

at least one center conductor disposed within the hollow, elongated chamber, wherein a portion of each center conductor extends beyond the hollow, elongated chamber;

an electrical coupler positioned concentric to the hollow, elongated chamber, wherein the electrical coupler surrounds the portion of each center conductor that extends beyond the hollow, elongated chamber and wherein the electrical coupler comprises a cylindrical conductor that provides an adjustable capacitance between the center conductor and the hollow elongated chamber;

an rf-power supply positioned in an operable relationship to the coupler; and an impedance matching network positioned in an operable relationship to the rf power supply and the coupler;

b) introducing at least one gas capable of forming an electronically excited molecular state into each center conductor;

c) pressurizing each gas in a range from about 0.2 torr to about 1500 torr;

d) inputting rf power into the impedance matching network wherein the rf power ranges from about 200 W to about 3000 W; and e) producing an excimer emission ranging from about 160 nm to about 200 nm.

13. A method according to claim 12, wherein the pressure is applied at a range from about 500 torr to about 1000 torr and wherein the input rf power is applied at a range from about 300 W to about 1000 W.

14. A method according to claim 12, wherein the gas capable of forming an electronically excited molecular state is a Xenon/Argon gas mixture.

* * * * *